US009434894B2

(12) United States Patent
Mehlberg et al.

(10) Patent No.: US 9,434,894 B2
(45) Date of Patent: Sep. 6, 2016

(54) PROCESS FOR CONVERTING FCC NAPHTHA INTO AROMATICS

(71) Applicant: UOP LLC, Des Plaines, IL (US)

(72) Inventors: Robert Mehlberg, Wheaton, IL (US); Robert Jason Lee Noe, Mount Prospect, IL (US); Antoine Negiz, Wilmette, IL (US); Steven F. Zink, Westmont, IL (US)

(73) Assignee: UOP LLC, Des Plaines, IL (US)

( * ) Notice: Subject to any disclaimer, the term of this patent is extended or adjusted under 35 U.S.C. 154(b) by 265 days.

(21) Appl. No.: 14/309,623

(22) Filed: Jun. 19, 2014

(65) Prior Publication Data

US 2015/0368571 A1 Dec. 24, 2015

(51) Int. Cl.

| | |
|---|---|
| ***C10G 69/08*** | (2006.01) |
| *C10G 69/00* | (2006.01) |
| *C10G 69/02* | (2006.01) |
| *C10G 63/00* | (2006.01) |
| *C10G 63/02* | (2006.01) |
| *C10G 63/04* | (2006.01) |

(52) U.S. Cl.

CPC ..... *C10G 69/08* (2013.01)

(58) Field of Classification Search

CPC ..... C10G 69/00; C10G 69/02; C10G 69/08; C10G 63/00; C10G 63/02; C10G 63/04

See application file for complete search history.

(56) References Cited

U.S. PATENT DOCUMENTS

| | | | | |
|---|---|---|---|---|
| 4,868,342 A | * | 9/1989 | Verson | C07C 9/16 568/697 |
| 5,082,983 A | | 1/1992 | Breckenridge et al. | |
| 5,380,425 A | | 1/1995 | Child et al. | |
| 5,396,010 A | | 3/1995 | Harandi et al. | |
| 5,552,033 A | | 9/1996 | Shih | |

(Continued)

FOREIGN PATENT DOCUMENTS

| | | | | |
|---|---|---|---|---|
| AU | 199728794 B2 | | 2/1999 | |
| WO | WO 89/07586 | * | 8/1989 | C07C 2/64 |
| WO | WO 2009101281 A2 | | 8/2009 | |

OTHER PUBLICATIONS

Mota et al., "Mechanism of aromatic hydrocarbon formation in FCC naphtha," Industrial & Engineering Chemistry Research (1995), 34(12), 4326-4332.

Gardner, Arthur S., "Petrochemicals: Refiners can profit by increasing production," Today's Refinery (1999), March edition, 13-14,16-17, 19.

Gentry et al., "Profitable desulfurisation," Hydrocarbon Engineering (2002), 7(2), 43-44.

*Primary Examiner* — Brian McCaig

(74) *Attorney, Agent, or Firm* — James C. Paschall

(57) ABSTRACT

A method and apparatus for processing hydrocarbons are described. The method includes fractionating a hydrocarbon stream to form at least two fractions. The first fraction is reformed to form a reformate stream, and the reformate stream is introduced into an aromatics processing zone to produce aromatic products. At least a portion of the second fraction is cracked in a fluid catalytic cracking unit. A selectively hydrogenated light naphtha stream is formed by separating the cracked hydrocarbon stream into at least two streams and selectively hydrogenating the light naphtha stream, or selectively hydrogenating the cracked hydrocarbon stream and separating the hydrogenated cracked hydrocarbon stream into at least two streams. Aromatics are extracted from the selectively hydrogenated light naphtha stream forming an extract stream and a raffinate stream. The extract stream is hydrotreated, sent to the aromatics processing zone to produce additional aromatic products.

20 Claims, 2 Drawing Sheets

(56) References Cited

U.S. PATENT DOCUMENTS

| | | | |
|---|---|---|---|
| 5,685,972 | A | 11/1997 | Timken et al. |
| 6,187,171 | B1 | 2/2001 | Tsuboi |
| 7,005,058 | B1 | 2/2006 | Towler |
| 7,267,761 | B2 | 9/2007 | Balko |
| 7,501,549 | B2 | 3/2009 | Podrebarac et al. |
| 2010/0155300 | A1 | 6/2010 | Sabottke et al. |
| 2012/0012504 | A1 | 1/2012 | Minami et al. |
| 2013/0267744 | A1 | 10/2013 | Kim et al. |
| 2015/0166435 | A1* | 6/2015 | Serban ..... C10G 35/00 585/321 |

* cited by examiner

PROCESS FOR CONVERTING FCC NAPHTHA INTO AROMATICS

BACKGROUND

Aromatics, particularly benzene, toluene, ethylbenzene, and the xylenes (ortho, meta, and para isomers), which are commonly referred to as "BTEX" or more simply "BTX," are extremely useful chemicals in the petrochemical industry. They represent the building blocks for materials such as polystyrene, styrene-butadiene rubber, polyethylene terephthalate, polyester, phthalic anhydride, solvents, polyurethane, benzoic acid, and numerous other components. Conventionally, BTX is obtained for the petrochemical industry by separation and processing of fossil-fuel petroleum fractions, for example, in catalytic reforming or cracking refinery process units, followed by BTX recovery units.

Typically, integrated refining-petrochemical complexes separate a crude feedstock into a "straight run" or desired fraction of naphtha, such as $C_6$-$C_{10}$ naphtha, i.e., naphtha containing hydrocarbons having carbon chain lengths of six to ten, and a heavier fraction containing longer chain hydrocarbons such as heavy oils and residues. The naphtha stream typically undergoes reforming to produce a reformate with an increased aromatic content. The reformate is processed in an aromatics complex to produce selected aromatic products, such as benzene and para-xylene.

The heavier fraction is typically cracked, for example in a fluid catalytic cracking (FCC) unit, to form a "heart cut" or desired fraction of hydrocarbons, such as $C_6$-$C_{10}$ FCC hydrocarbons. FCC naphtha has had limited application in aromatic manufacture because of its alternate use in gasoline blending. In addition, olefins present in FCC naphtha may be converted into other less desired compounds if it combined with straight run naphtha and sent to a reformer. Furthermore, the presence of contaminants, such as sulfur, nitrogen, and dienes, affect aromatics extraction and reduce the hydrogen yield from reforming. As a result, virgin naphthas are typically used for aromatics.

Because aromatics are the building blocks of so many materials, there is a need to increase production of desired aromatics from integrated refining-petrochemical complexes. There is also a need to increase aromatics production without decreasing the value of other streams produced in the integrated refining-petroleum complexes, such as gasoline blends.

Therefore, there is a need for processes for converting FCC into aromatics.

SUMMARY OF THE INVENTION

One aspect of the invention is a method for processing hydrocarbons. In one embodiment, the method includes fractionating a hydrocarbon stream in a fractionation unit to form at least two fractions including a first fraction and a second fraction; reforming the first fraction in a reforming unit to form a reformate stream; introducing the reformate stream into an aromatics processing zone to produce aromatic products; cracking at least a portion of the second fraction in a fluid catalytic cracking unit to form a cracked hydrocarbon stream; forming a selectively hydrogenated light naphtha stream by separating the cracked hydrocarbon stream into at least two streams including a light naphtha stream and a heavy naphtha stream and selectively hydrogenating the light naphtha stream, or selectively hydrogenating the cracked hydrocarbon stream and separating the hydrotreated cracked hydrocarbon stream into at least two streams including a light naphtha stream and a heavy naphtha stream; extracting aromatics from the selectively hydrogenated light naphtha stream in an aromatic extraction unit to form an extract stream and a raffinate stream containing olefins; hydrotreating the extract stream; and introducing the hydrotreated extract stream into the aromatics processing zone to produce additional aromatic products.

Another aspect of the invention involves an apparatus for processing hydrocarbons. In one embodiment, the apparatus includes a fractionation unit having an inlet and upper and lower outlets; a reforming unit having an inlet in fluid communication with the upper outlet of the fractionation unit; and an aromatics processing unit in fluid communication with an outlet of the reforming unit; a fluid catalytic cracking unit having an inlet in fluid communication with the lower outlet of the fractionation unit; a selective hydrogenation unit having an inlet in fluid communication with an outlet of the fluid catalytic cracking unit; an aromatic extraction unit having an inlet in fluid communication with an outlet of the selective hydrotreating unit; and a hydrotreating unit having an inlet in fluid communication with an outlet of the aromatic extraction unit and an outlet in fluid communication with the aromatics processing unit.

BRIEF DESCRIPTION OF THE DRAWING

Embodiments of methods and apparatuses for processing hydrocarbons will hereinafter be described in conjunction with the following drawing figures wherein.

DETAILED DESCRIPTION OF THE INVENTION

Various embodiments of methods and apparatus for converting FCC naphtha with enhanced production of valuable product streams are described herein. For example, embodiments herein provide for the enhanced production of aromatics, such as for example benzene, toluene, and xylene (BTX). The embodiments produce additional aromatics from FCC $C_6$-$C_{10}$ hydrocarbon streams as compared to conventional processing. Exemplary embodiments utilize aromatics recovery from the FCC $C_6$-$C_{10}$ hydrocarbon stream and do not reform those aromatics. In one embodiment, an extract stream including aromatics is removed from the FCC $C_6$-$C_{10}$ hydrocarbon stream and fed to an aromatics complex including fractionation and isomerization units to produce streams of desired aromatic species. In another embodiment, the extraction of aromatics from the FCC $C_6$-$C_{10}$ hydrocarbon stream forms a raffinate comprising primarily paraffins and olefins and an extract that is fed to an aromatics complex.

Figure 1:
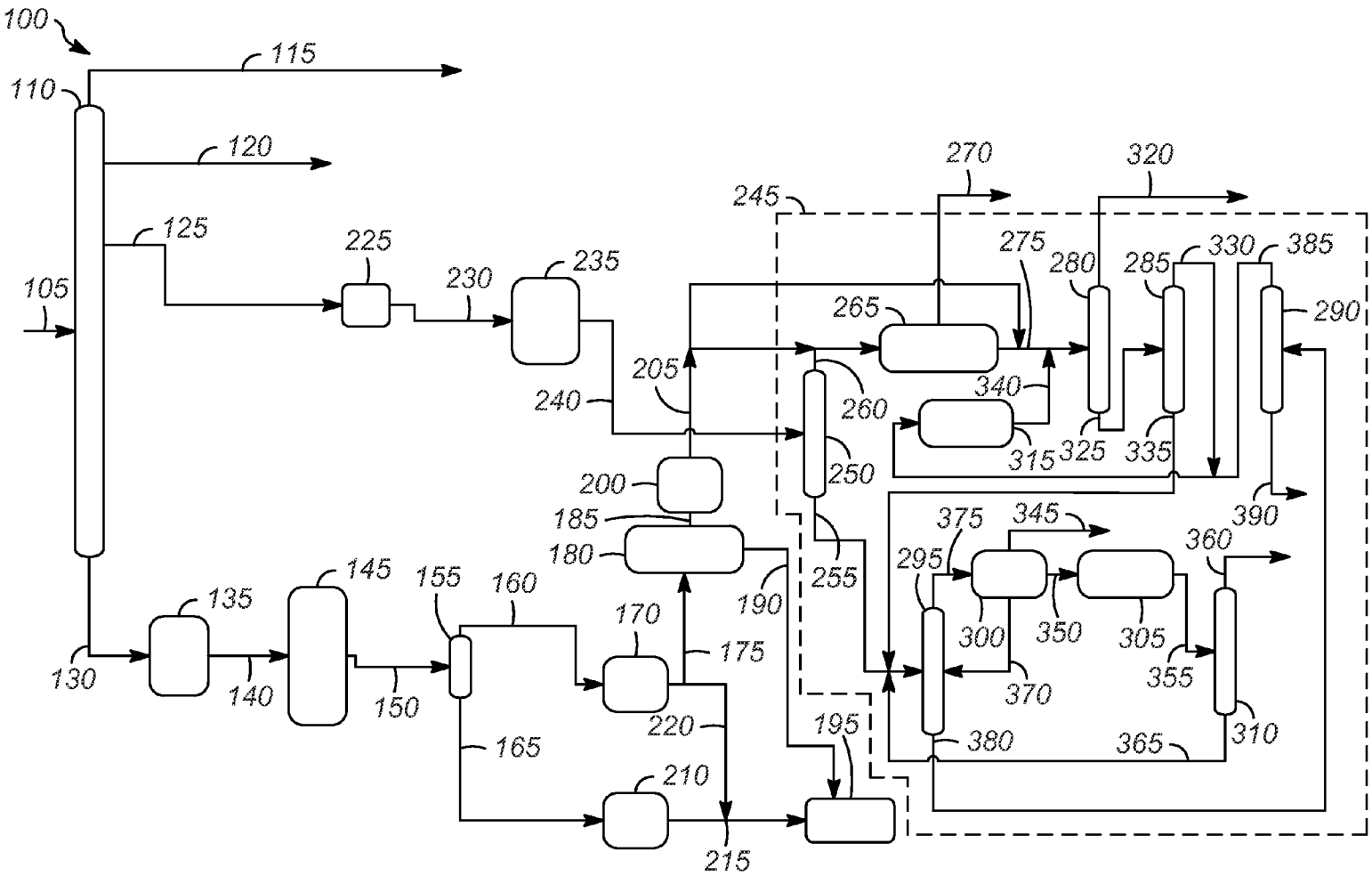
FIG. 1 is a schematic diagram of one embodiment of an apparatus and method for processing hydrocarbons.

Referring to FIG. 1, one embodiment of the process 100 is illustrated. The feedstock 105 is fed to a crude distillation column 110 where it is fractionated into two or more streams. An exemplary feedstock 105 is crude oil or may be other hydrocarbon streams. As shown, the feedstock 105 is fractionated into stream 115, such an overhead stream, containing liquefied petroleum gas, a stream 120, such as an upper sidedraw stream, containing light naphtha such as naphtha containing hydrocarbons with carbon chains lengths of 5 or less, a stream 125, such as lower sidedraw stream, containing heavy or straight-run naphtha, for example $C_6$-$C_{10}$ naphtha (naphtha including hydrocarbons having carbon chain lengths of six to ten), and a stream 130, such as a bottom stream, containing $C_{11+}$ hydrocarbon (hydrocarbons having carbon chain lengths of eleven or greater than eleven) such as heavy oils and residues.

In the exemplary embodiment, the stream 130 is processed by a residue hydrotreating unit 135 that removes sulfur, nitrogen, organometallics, and asphaltenes from the stream 130 to form a hydrotreated stream 140. The residue hydrotreating unit 135 may use a fixed-bed catalytic hydrotreating process with catalysts employed to facilitate demetallization and desulfurization.

The exemplary hydrotreated stream 140 is fed to a fluid catalytic cracking (FCC) unit 145. In an exemplary embodiment, the FCC unit 145 is run under severe FCC conditions to form a mixture of cracked hydrocarbons which exits the FCC unit as effluent 150. Under severe FCC processing, the aromatic content of the naphtha portion of cracked stream may be as high as about 50 weight percent (wt %) to about 70 wt %.

The cracked naphtha effluent 150 is sent to a catalytic naphtha splitter 155. The effluent 150 is separated into at least two streams including a light naphtha stream 160 and a heavy naphtha stream 165. The light naphtha stream 160 typically comprises $C_5$ to $C_9$ hydrocarbons. In some embodiments, a very light naphtha stream of $C_5$ and $C_6$ hydrocarbons lighter than benzene is also formed (not shown). This very light naphtha stream can be sent directly to blending without extraction because there are very few aromatics in it. In this case, the light naphtha stream 160 would include $C_6$ to $C_9$ hydrocarbons. The heavy naphtha stream comprises $C_{10+}$ hydrocarbons. Other fractions could also be formed (not shown).

The light naphtha stream 160 is fed to a selective hydrogenation unit 170, in one embodiment. The selective hydrogenation unit 170 saturates diolefins in the light hydrocarbon stream 160, which helps to control fouling of the extraction equipment. Further, the selective hydrogenation unit 170 converts at least mercaptans in the light hydrocarbon stream 160 to higher molecular weight sulfide compounds which can be separated from the hydrotreated light hydrocarbon stream lowering its sulfur content. Exemplary selective hydrogenation conditions include a temperature of about 40° C. to about 200° C. and a pressure of about 1000 kilopascals (kPa) to about 4000 kPa. As a result of the selective hydrogenation process, a selectively hydrogenated stream 175 is formed with a reduced diolefin and mercaptan content.

Alternatively, the selective hydrogenation unit 170 could be located before the catalytic naphtha splitter 155. In this case, the effluent stream 150 would be sent to the selective hydrogenation unit 170. The hydrogenated effluent would then be separated in the catalytic naphtha splitter 155 into the light and heavy naphtha streams 160 and 165 (and any other streams). In this alternative, higher molecular weight sulfides formed from the mercaptans in effluent stream 150 by the selective hydrogenation unit 170 are removed from the light naphtha stream 160 lowering its sulfur content, and the fouling tendency of the naphtha splitter bottoms 165 is reduced.

In either case, the selectively hydrogenated stream 175 is sent to an aromatics extraction unit 180. The aromatics extraction unit 180 removes aromatics, sulfur and nitrogen compounds as an extract stream 185 from the remaining paraffins and olefins that form a raffinate stream 190. Typically, aromatics cannot be directly recovered at high purity by conventional distillation because of the close boiling components and azeotropes that form with aromatics. Therefore, they are typically recovered by extraction with a selective solvent. This can be accomplished through liquid-liquid extraction or by extractive distillation. An exemplary aromatics extraction unit 180 is an extractive distillation unit. An exemplary solvent is sulfolane to separate aromatic compounds from non-aromatic compounds. An exemplary raffinate stream 190 primarily contains $C_6$-$C_7$ paraffins and olefins, such as greater than about 80%, greater than about 90%, or greater than about 95%, paraffins and olefins.

In some embodiments, selectively hydrotreated pyrolysis naphtha is introduced into the aromatic extraction unit 180 (not shown).

As shown in FIG. 1, the raffinate stream 190 is blended in a gasoline pool 195. The aromatics extraction unit 180 also removes sulfur compounds and nitrogen compounds so that the raffinate stream 190 has improved quality for blending in the gasoline pool 195.

The aromatics extract stream 185 is sent to a naphtha hydrotreating unit 200. By placing the naphtha hydrotreating unit 200 after the aromatics extraction unit 180, all of the sulfur can be removed because the naphtha hydrotreating unit 200 can be run under severe conditions. Operating under these conditions is possible because the olefins have already been removed. In addition, only a small stream is treated.

The hydrotreated extract stream 205 is then sent the aromatics complex 245 for further treatment, as will be discussed below.

The heavy naphtha stream 165 from the catalytic naphtha splitter 155 is sent to a naphtha hydrotreating unit 210 for removal of sulfur compounds. The hydrotreated heavy naphtha stream 215 can be sent to the gasoline pool 195, if desired.

A portion 220 of the selectively hydrogenated stream 175 can be sent to the gasoline pool for blending, if desired.

The stream 125, containing heavy or straight-run naphtha, for example $C_6$-$C_{10}$ naphtha, is processed by a naphtha hydrotreating unit 215 to form a hydrotreated stream 230. The naphtha hydrotreating unit 225 may be used to prepare the $C_6$-$C_{10}$ cut of naphtha in stream 125 for downstream reforming with sensitive noble metal catalyst systems. In an exemplary process, the stream 125 is brought into the naphtha hydrotreating unit 225, mixed with hydrogen, and heated to a reaction temperature over a catalyst. Exemplary catalysts include metals from CAS Group VIB, VIIB, VIII, and combinations thereof. The naphtha hydrotreating unit 225 may have multiple distinct stages with different catalytic zones. For example, the first stage can be operated at low temperature (e.g., about 40° C. to about 250° C.) for mainly diolefin removal, and the second stage can be operated at higher temperature (e.g., up to about 400° C.) for olefin, sulfur, and nitrogen content reduction. For a single stage, exemplary reaction temperatures are from about 250° C. to about 400° C. The main catalytic reactions in unit 225 convert the contaminants of noble metal catalyst systems, such as sulfur, nitrogen, and oxygenates, via hydrogenolysis reactions to hydrogen sulfide, ammonia, and water so that they can be removed from the naphtha stream. Metals in the naphtha may be removed by adsorption onto the catalyst. As a result, olefins and/or diolefins are also saturated.

The resulting hydrotreated stream 230 contains paraffins, and low levels of olefins and naphthenes and is fed to a reforming unit 235 for conversion into aromatics. An exemplary reforming unit 235 is a catalytic reforming unit with continuous catalyst regeneration (CCR). The reforming unit 235 may be operated at a temperature of from about 495° C. to about 560° C. Compounds in the hydrotreated stream 230 are reformed to produce a reformate stream 240. Specifically, naphthenes are dehydrogenated to form aromatics, normal paraffins are isomerized to form isoparaffins, and paraffins are dehydrocyclized, i.e., dehydrogenated and aromatized, to form aromatics. Further, the aromatics present in the hydrotreated stream 230 can undergo demethylation and dealkylation reactions.

In the exemplary embodiment, the reformate stream 240 is fed to an aromatics complex 245, and specifically to a reformate splitter distillation column 250 therein. The reformate splitter distillation column 250 functions to separate or "split" the reformate stream 240 by distilling the reformate stream 240 into a heavier higher boiling fraction as stream 255 and a lighter, lower boiling fraction as stream 260. The reformate splitter distillation column 250 may be configured such that, for example, the heavier fraction in stream 255 includes primarily, such as greater than about 80%, greater than about 90%, or greater than about 95%, hydrocarbons having eight or more carbon atoms ($C_{8+}$). The lighter fraction in stream 260 may include primarily (such as greater than about 80%, greater than about 90%, or greater than about 95%) hydrocarbons having seven or fewer carbon atoms ($C_{7-}$).

The lighter fraction 260 is passed from the reformate splitter distillation column 250 to an extractive distillation process unit 265 for removing non-aromatic compounds from the lighter fraction 260. In one particular embodiment, extractive distillation process unit 265 may employ a sulfolane solvent to separate aromatic compounds from non-aromatic compounds. Other extraction methods, such as liquid-liquid solvent extraction are also well-known and practiced for separation of non-aromatic compounds from aromatic compounds, and their use in place of, or in addition to, extractive distillation process unit 265 is contemplated herein. Extractive distillation process unit 265 produces a raffinate stream 270 that includes primarily, such as greater than about 80%, greater than about 90%, or greater than about 95%, non-aromatic $C_{7-}$ hydrocarbons and an extract stream 275 that includes primarily, such as greater than about 80%, greater than about 90%, or greater than about 95%, benzene and toluene. The raffinate stream 270 may be sold as petrochemical naphtha to steam crackers, the $C_5$-$C_6$ hydrocarbons can be isomerized to higher octane, and the $C_{7+}$ hydrocarbons can be sent back to the reformer.

The hydrotreated extract stream 205 formed by the hydrotreating unit 200 is fed to the aromatics complex 245 and is combined with extract stream 275 for processing in the aromatics complex 245. Alternatively, the hydrotreated extract stream 205 could be combined with the lighter fraction 260 from the reformate splitter distillation column 250 to the extractive distillation process unit 265. This arrangement is less desirable because the hydrotreated extraction stream has already gone through the extraction process in aromatics extraction unit 180. The aromatics complex 245 includes a benzene distillation column 280, a toluene distillation column 285, a heavy aromatic distillation column 290, a xylene distillation column 295, a para xylene separation unit 300, a xylene isomerization unit 305, a light distillation unit 310, and a toluene disproportionation and transalkylation process unit 315.

A fractionation process is performed on the streams 275, 340, and 205 in the benzene distillation column 280 and benzene, having a lower boiling point than toluene, is removed from benzene distillation column 280 as a product stream 320. Toluene, having a higher boiling point than benzene, is removed from distillation column 280 as stream 325. Stream 325 may further include heavier aromatic hydrocarbons such as various xylene isomers. Stream 325 is fed to the toluene distillation column 285.

In the toluene distillation column 285, toluene is separated from heavier components, i.e., components having lower boiling points than toluene, and is removed as overhead stream 330. The heavier aromatic hydrocarbons are removed as bottoms stream 335. As shown, the toluene rich stream 330 is fed to the toluene disproportionation and transalkylation process unit 315. The toluene disproportionation and transalkylation process unit 315 converts toluene into benzene and xylenes in a toluene disproportionation process. Further, the toluene disproportionation and transalkylation process unit 315 converts a mixture of toluene and aromatic hydrocarbons having nine or more carbon atoms ($C_{9+}$) into xylenes in a transalkylation process. Hydrogen is fed to the toluene disproportionation and transalkylation process unit 315 so that the disproportionation and transalkylation processes are conducted in a hydrogen atmosphere to minimize coke formation. As shown, a stream 340 of benzene, toluene and xylenes exits the toluene disproportionation and transalkylation process unit 315 and is recycled to the benzene distillation column 280 for further processing.

Stream 335, including a mixture of xylenes, exits the toluene distillation column 285 and is fed to xylene distillation column 295. Stream 375 rich in xylenes from column 295 is fed to the para-xylene separation unit 300. Separation of para-xylene from the other xylenes in the para-xylene separation unit 300 results in the formation of an extract stream 345 containing para-xylene. A raffinate stream 350 is fed to the xylene isomerization unit 305 which reestablishes an equilibrium mixture of isomers via xylene isomerization and conversion of ethyl benzene to benzene or xylenes. The isomerized effluent 355 formed by the xylene isomerization unit 305 is fed to the light distillation unit 310, which forms an overhead stream 360, primarily containing benzene, toluene, and ethylbenzene, and a bottoms stream 365, containing $C_{8+}$ aromatics including primarily ortho-, meta-, para-xylenes. Stream 365 is combined with the $C_{8+}$ fraction 255 from the reformate splitter distillation column 250 and stream 335 containing $C_{8+}$ from the toluene distillation column 285. The combined stream is fed to the xylene distillation column 295. As shown, the xylene distillation column 295 further receives a bottom raffinate stream 370 from the para-xylene separation unit 300.

The xylene distillation column 295 produces an overhead stream 375, containing xylenes. In one embodiment, stream 375 is fed to para-xylene separation unit 300. In another embodiment stream 375 can be combined with the heavier aromatic hydrocarbons in stream 335 from the toluene distillation column 285 and is fed to the para-xylene separation unit 300.

A bottoms stream 380, including heavier components, is removed from the xylene distillation column 295 and is fed to the heavy aromatic distillation column 290. The heavy aromatic distillation column 290 removes any lighter aromatics present in stream 380 as an overhead stream 385. Stream 385 is combined with the toluene in stream 330 and is fed to the toluene disproportionation and transalkylation process unit 315. Heavy aromatics are removed from the process in a bottoms stream 390.

The aromatics in the hydrotreated extract stream 205 removed from the FCC light hydrocarbon fraction in the aromatics extraction unit 180 are sent to the aromatics complex 245 and do not undergo processing in the reforming unit 235. As a result, as compared to conventional processing in which aromatics are passed through the reforming unit 235, the flow rate to the reforming unit is reduced, the catalyst volume in the reforming reactors is reduced, the hydrogen requirement is reduced, and more para-xylene is produced in the aromatics complex. Para-xylene production is increased because the methyl groups from the extracted aromatics are conserved and the aromatics avoid dealkylation in the reforming unit, resulting in a higher methyl/phenyl ratio and higher para-xylene production. Further, an increased proportion of the olefinic FCC raffinate stream 190 is retained for use in gasoline blending in comparison to conventional processing. As a result, gasoline blending may attain high octane products without, or with only limited, addition of methyl tertiary butyl ether (MTBE) to the gasoline blend.

Figure 2:
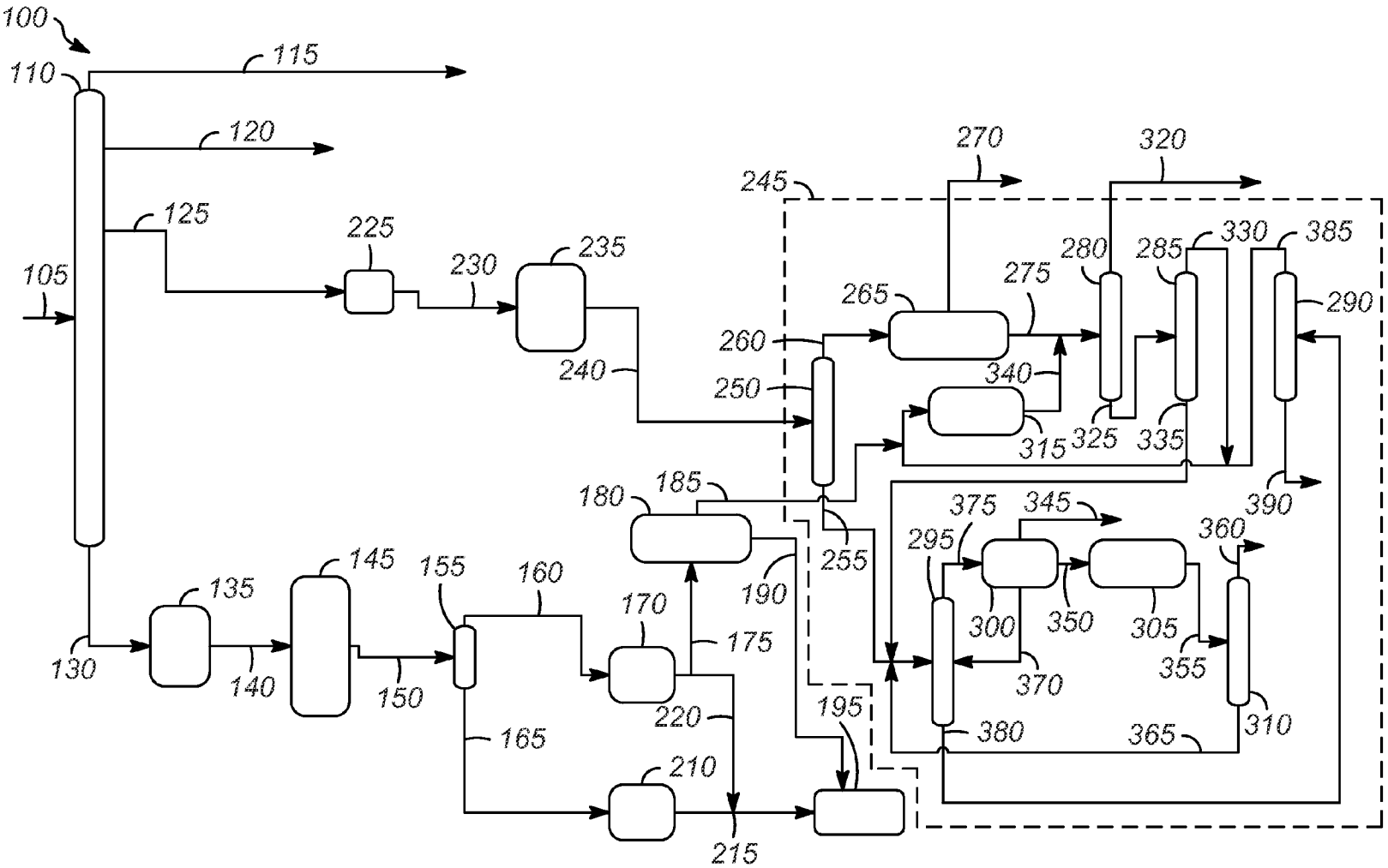
FIG. 2 is a schematic diagram of another embodiment of an apparatus and method for processing hydrocarbons.

In another embodiment as shown in FIG. 2, the stream 185 expected to contain sulfur components can be fed to unit 315 along with streams 330 and 385. In this embodiment, the transalkylation catalyst or catalysts in unit 315 are formulated in such a way that they can also promote hydrotreating reactions such as converting all sulfur containing components to hydrogen sulfide at very high conversions per pass, for example greater than 99%. Hence in this embodiment, there will be no need for the hydrotreating unit 200. Consequently, the aromatics extract stream in line 185 is hydrotreated in the toluene disproportionation and transalkylation process unit 315 and is not separately hydrotreated in a hydrotreating unit 200.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

What is claimed:

1. A method for processing hydrocarbons comprising:

fractionating a hydrocarbon stream in a fractionation unit to form at least two fractions including a first fraction and a second fraction;

reforming the first fraction in a reforming unit to form a reformate stream;

introducing the reformate stream into an aromatics processing zone to produce select aromatic products;

cracking at least a portion of the second fraction in a fluid catalytic cracking unit to form a cracked hydrocarbon stream;

forming a selectively hydrogenated light naphtha stream by separating the cracked hydrocarbon stream into at least two streams including a light naphtha stream and a heavy naphtha stream and selectively hydrogenating the light naphtha stream, or selectively hydrogenating the cracked hydrocarbon stream and separating the hydrogenated cracked hydrocarbon stream into at least two streams including a light naphtha stream and a heavy naphtha stream;

extracting aromatics from the selectively hydrogenated light naphtha stream in an aromatic extraction unit to form an extract stream and a raffinate stream containing olefins; and introducing the extract stream into the aromatics processing zone to produce additional aromatic products.

2. The method of claim 1 wherein the selectively hydrogenated light naphtha stream is formed by separating the cracked hydrocarbon stream into at least two streams including the light naphtha stream and the heavy naphtha stream and selectively hydrogenating the light naphtha stream.

3. The method of claim 2 further comprising at least one of:

hydrotreating the heavy naphtha stream and blending the hydrogenated heavy naphtha stream into gasoline; and blending a portion of the selectively hydrogenated light naphtha stream with gasoline.

4. The method of claim 1 further comprising:

blending the raffinate stream containing the olefins with gasoline.

5. The method of claim 1 wherein the selectively hydrogenated light naphtha stream is formed by selectively hydrogenating the cracked hydrocarbon stream and separating the hydrogenated cracked hydrocarbon stream into at least two streams including a light naphtha stream and a heavy naphtha stream.

6. The method of claim 1 further comprising combining at least a portion of the reformate stream with the extract stream.

7. The method of claim 6 wherein combining at least the portion of the reformate stream with the extract stream comprises combining the reformate stream with the extract stream before introducing the combined stream into the aromatics processing zone.

8. The method of claim 1 wherein the aromatics processing zone comprises at least a second aromatic extraction unit and a separation unit, and wherein introducing the reformate stream into the aromatics processing zone comprises introducing the reformate stream into the second aromatic extraction unit, and further comprising:

extracting aromatics from the reformate stream in the second aromatic extraction unit to form a reformate extract stream and a reformate raffinate stream;

and wherein the extract stream is hydrotreated before introducing the extract stream into the aromatics processing zone, and wherein introducing the extract stream into the aromatics processing zone comprises combining the hydrotreated extract stream with the reformate extract stream and further processing the combined stream in the separation unit.

9. The method of claim 1 further comprising at least one of:

hydrotreating the heavy naphtha stream and blending the hydrotreated heavy naphtha stream into gasoline; and blending a portion of the light naphtha stream into gasoline.

10. The method of claim 1 further comprising introducing selectively hydrotreated pyrolysis naphtha to the aromatic extraction unit.

11. The method of claim 1 wherein the aromatics processing zone comprises at least a second aromatic extraction unit, a separation unit, and a toluene disproportionation and transalkylation process unit, and wherein introducing the extract stream into the aromatics processing zone comprises introducing the extract stream into the toluene disproportionation and transalkylation process unit, and further comprising hydrotreating the extract stream in the toluene disproportionation and transalkylation process unit.

12. The method of claim 1 further comprising hydrotreating the extract stream prior to introducing the extract stream into the aromatics processing zone.

13. A method for processing hydrocarbons comprising:

fractionating a hydrocarbon stream in a fractionation unit to form at least two fractions including a $C_6$-$C_{10}$ fraction and a $C_{11+}$ fraction;

reforming the $C_6$-$C_{10}$ fraction in a reforming unit to form a reformate stream;

introducing the reformate stream to an aromatics processing zone to produce select aromatic products;

cracking at least a portion of the $C_{11+}$ fraction in a fluid catalytic cracking unit to form a cracked stream;

forming a selectively hydrogenated first stream comprising at least $C_6$-$C_9$ hydrocarbons by separating the cracked stream into at least two streams including the first stream comprising at least the $C_6$-$C_9$ hydrocarbons and a second stream comprising $C_{10+}$ hydrocarbons and selectively hydrogenating the first stream comprising at least the $C_6$-$C_9$ hydrocarbons, or selectively hydrogenating the cracked stream and separating the hydrogenated cracked stream into at least two streams including the first stream comprising at least the $C_6$-$C_9$ hydrocarbons and a second stream comprising $C_{10+}$ hydrocarbons;

extracting aromatics from the selectively hydrogenated first stream comprising at least the $C_6$-$C_9$ hydrocarbons in an aromatic extraction unit to form an extract stream and a raffinate stream containing olefins; and introducing the extract stream into the aromatics processing zone to produce additional aromatic products.

14. The method of claim 13 wherein the selectively hydrogenated first stream comprising at least $C_6$-$C_9$ hydrocarbons is formed by separating the cracked stream into at least two streams including the first stream comprising at least the $C_6$-$C_9$ hydrocarbons and the second stream comprising $C_{10+}$ hydrocarbons and selectively hydrogenating the first stream comprising at least the $C_6$-$C_9$ hydrocarbons.

15. The method of claim 14 further comprising at least one of:

hydrotreating the second stream comprising the $C_{10+}$ hydrocarbons and blending the hydrotreated second stream comprising $C_{10+}$ hydrocarbons into gasoline; and blending a portion of the selectively hydrogenated first stream comprising at least the $C_6$-$C_9$ hydrocarbons with gasoline.

16. The method of claim 13 further comprising introducing selectively hydrotreated pyrolysis naphtha to the aromatic extraction unit.

17. The method of claim 13 wherein the selectively hydrogenated first stream comprising at least $C_6$-$C_9$ hydrocarbons is formed by selectively hydrogenating the cracked stream and separating the hydrogenated cracked stream into at least two streams including the first stream comprising at least the $C_6$-$C_9$ hydrocarbons and a second stream comprising $C_{10+}$ hydrocarbons.

18. The method of claim 13 further comprising combining at least a portion of the reformate stream with the extract stream before introducing the combined stream into the aromatics processing zone.

19. The method of claim 13 wherein the aromatics processing zone comprises at least a second aromatic extraction unit and a separation unit, and wherein introducing the reformate stream into the aromatics processing zone comprises introducing the reformate stream into the second aromatic extraction unit, and further comprising:

extracting aromatics from the reformate stream in the second aromatic extraction unit to form a reformate extract stream and a reformate raffinate stream;

hydrotreating the extract stream prior to introducing into the aromatics processing zone; and wherein introducing the extract stream into the aromatics processing zone comprises combining the extract stream after the hydrotreating with the reformate extract stream to form a combined stream and further processing the combined stream in the separation unit.

20. The method of claim 13 wherein the aromatics processing zone comprises at least a second aromatic extraction unit, a separation unit, and a toluene disproportionation and transalkylation process unit, and wherein introducing the extract stream into the aromatics processing zone comprises introducing the extract stream into the toluene disproportionation and transalkylation process unit, and further comprising hydrotreating the extract stream in the toluene disproportionation and transalkylation process unit.

* * * * *